US009145223B2

(12) United States Patent
Melrose et al.

(10) Patent No.: US 9,145,223 B2
(45) **Date of Patent: *Sep. 29, 2015**

(54) CONTAINER STRUCTURE FOR REMOVAL OF VACUUM PRESSURE

(75) Inventors: David Melrose, Auckland (NZ); John Denner, York, PA (US); Paul Kelley, Wrightsville, PA (US)

(73) Assignee: CO2 PAC LIMITED (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,572

(22) Filed: Mar. 5, 2012

(65) Prior Publication Data

US 2013/0043208 A1 Feb. 21, 2013

Related U.S. Application Data

(63) Continuation of application No. 11/704,338, filed on Feb. 9, 2007, now Pat. No. 8,127,955, which is a continuation-in-part of application No. 10/529,198, filed as application No. PCT/NZ03/00220 on Sep. 30, (Continued)

(30) Foreign Application Priority Data

| | | |
|---|---|---|
| Aug. 31, 2000 | (NZ) | 506684 |
| Jun. 15, 2001 | (NZ) | 512423 |
| Sep. 30, 2002 | (NZ) | 521694 |

(51) Int. Cl.
*B65D 1/02* (2006.01)
*B65D 79/00* (2006.01)

(52) U.S. Cl.
CPC ..... *B65D 1/0276* (2013.01); *B65D 79/005* (2013.01)

(58) Field of Classification Search
CPC ... B65D 1/0261; B65D 1/0284; B65D 79/005
USPC ..... 215/373–375, 900, 376; 220/604, 606, 220/608, 609, 624
See application file for complete search history.

(56) References Cited

U.S. PATENT DOCUMENTS

| | | | |
|---|---|---|---|
| 1,499,239 | A | 6/1924 | Malmquist |
| D110,624 | S | 7/1938 | Mekeel, Jr. |

(Continued)

FOREIGN PATENT DOCUMENTS

| | | |
|---|---|---|
| CA | 2077717 | 3/1993 |
| DE | 1302048 | 10/1969 |

(Continued)

OTHER PUBLICATIONS

European Search Report (suppl.) of EP 03748817, dated Jul. 9, 2007.

(Continued)

*Primary Examiner* — Sue A Weaver
(74) *Attorney, Agent, or Firm* — Henricks, Slavin & Holmes LLP

(57) ABSTRACT

A container has a longitudinal axis, and comprises an upper portion including an opening into the container, a sidewall portion extending from the upper portion to a lower portion, the lower portion including a base, and a pressure panel located in the lower portion substantially transversely to the longitudinal axis, the pressure panel being movable substantially along the longitudinal axis between an initial position and an inverted position to compensate for a change of pressure induced within the container. The pressure panel comprises an initiator portion and a control portion, the initiator portion adapted to move in response to the change of pressure prior to the control portion.

15 Claims, 17 Drawing Sheets

Related U.S. Application Data

2003, now Pat. No. 8,152,010, which is a continuation-in-part of application No. 11/432,715, filed on May 12, 2006, now Pat. No. 7,717,282, which is a continuation of application No. 10/363,400, filed as application No. PCT/NZ01/00176 on Aug. 29, 2001, now Pat. No. 7,077,279.

(56) References Cited

U.S. PATENT DOCUMENTS

| | | | |
|---|---|---|---|
| 2,124,959 | A | 7/1938 | Vogel |
| 2,378,324 | A | 6/1945 | Ray et al. |
| 2,880,902 | A | 4/1959 | Owsen |
| 2,960,248 | A | 11/1960 | Kuhlman |
| 2,971,671 | A | 2/1961 | Shakman |
| 2,982,440 | A | 5/1961 | Harrison |
| 3,043,461 | A | 7/1962 | Glassco |
| 3,081,002 | A | 3/1963 | Tauschinski et al. |
| 3,174,655 | A | 3/1965 | Hurschman |
| 3,301,293 | A | 1/1967 | Santelli |
| 3,397,724 | A | 8/1968 | Bolen et al. |
| 3,409,167 | A | 11/1968 | Blanchard |
| 3,426,939 | A | 2/1969 | Young |
| 3,468,443 | A | 9/1969 | Marcus |
| 3,483,908 | A | 12/1969 | Donovan |
| 3,485,355 | A | 12/1969 | Stewart |
| 3,693,828 | A | 9/1972 | Kneusel et al. |
| 3,704,140 | A | 11/1972 | Petit et al. |
| 3,727,783 | A | 4/1973 | Carmichael |
| 3,819,789 | A | 6/1974 | Parker |
| 3,883,033 | A | 5/1975 | Brown |
| 3,904,069 | A | 9/1975 | Toukmanian |
| 3,918,920 | A | 11/1975 | Barber |
| 3,935,955 | A | 2/1976 | Das |
| 3,941,237 | A | 3/1976 | MacGregor |
| 3,942,673 | A | 3/1976 | Lyu et al. |
| 3,949,033 | A | 4/1976 | Uhlig |
| 4,036,926 | A | 7/1977 | Chang |
| 4,037,752 | A | 7/1977 | Dulmaine et al. |
| 4,117,062 | A | 9/1978 | Uhlig |
| 4,125,632 | A | 11/1978 | Vosti et al. |
| 4,134,510 | A | 1/1979 | Chang |
| 4,170,622 | A | 10/1979 | Uhlig |
| 4,174,782 | A | 11/1979 | Obsomer |
| 4,219,137 | A | 8/1980 | Hutchens |
| 4,231,483 | A | 11/1980 | Dechenne et al. |
| 4,247,012 | A | 1/1981 | Alberghini |
| 4,301,933 | A | 11/1981 | Yoshino et al. |
| 4,318,489 | A | 3/1982 | Snyder et al. |
| 4,318,882 | A | 3/1982 | Agrawal et al. |
| 4,321,483 | A | 3/1982 | Dugan |
| 4,338,765 | A | 7/1982 | Ohmori et al. |
| 4,355,728 | A | 10/1982 | Ota et al. |
| 4,377,191 | A | 3/1983 | Yamaguchi |
| 4,378,328 | A | 3/1983 | Przytulla |
| 4,381,061 | A | 4/1983 | Cerny et al. |
| D269,158 | S | 5/1983 | Gaunt et al. |
| 4,386,701 | A | 6/1983 | Galer |
| 4,412,866 | A | 11/1983 | Schoenrock et al. |
| 4,436,216 | A | 3/1984 | Chang |
| 4,444,308 | A | 4/1984 | MacEwen |
| 4,450,878 | A | 5/1984 | Takada et al. |
| 4,465,199 | A | 8/1984 | Aoki |
| 4,497,855 | A | 2/1985 | Agrawal et al. |
| 4,542,029 | A | 9/1985 | Caner et al. |
| 4,610,366 | A | 9/1986 | Estes et al. |
| 4,628,669 | A | 12/1986 | Herron et al. |
| 4,642,968 | A | 2/1987 | McHenry et al. |
| 4,645,078 | A | 2/1987 | Reyner |
| 4,667,454 | A | 5/1987 | McHenry et al. |
| 4,684,025 | A | 8/1987 | Copland et al. |
| 4,685,273 | A | 8/1987 | Caner et al. |
| D292,378 | S | 10/1987 | Brandt et al. |
| 4,749,092 | A | 6/1988 | Sugiura et al. |
| 4,773,458 | A | 9/1988 | Touzani |
| 4,785,949 | A | 11/1988 | Krishnakumar et al. |
| 4,785,950 | A | 11/1988 | Miller et al. |
| 4,807,424 | A | 2/1989 | Robinson et al. |
| 4,813,556 | A | 3/1989 | Lawrence |
| 4,831,050 | A | 5/1989 | Cassidy et al. |
| 4,836,398 | A | 6/1989 | Leftault, Jr. et al. |
| 4,840,289 | A | 6/1989 | Fait et al. |
| 4,850,493 | A | 7/1989 | Howard, Jr. |
| 4,850,494 | A | 7/1989 | Howard, Jr. |
| 4,865,206 | A | 9/1989 | Behm et al. |
| 4,867,323 | A | 9/1989 | Powers |
| 4,880,129 | A | 11/1989 | McHenry et al. |
| 4,887,730 | A | 12/1989 | Touzani |
| 4,892,205 | A | 1/1990 | Powers et al. |
| 4,896,205 | A | 1/1990 | Weber |
| 4,921,147 | A | 5/1990 | Poirier |
| 4,967,538 | A | 11/1990 | Leftault et al. |
| 4,976,538 | A | 12/1990 | Ake |
| 4,978,015 | A | 12/1990 | Walker |
| 4,997,692 | A | 3/1991 | Yoshino |
| 5,004,109 | A | 4/1991 | Bartley |
| 5,005,716 | A | 4/1991 | Eberle |
| 5,014,868 | A | 5/1991 | Wittig et al. |
| 5,024,340 | A | 6/1991 | Alberghini et al. |
| 5,060,453 | A | 10/1991 | Alberghini et al. |
| 5,067,622 | A | 11/1991 | Garver et al. |
| 5,090,180 | A | 2/1992 | Sorensen |
| 5,092,474 | A | 3/1992 | Leigner |
| 5,133,468 | A | 7/1992 | Brunson et al. |
| 5,141,121 | A | 8/1992 | Brown et al. |
| 5,178,290 | A | 1/1993 | Ota et al. |
| 5,199,587 | A | 4/1993 | Ota et al. |
| 5,199,588 | A | 4/1993 | Hayashi |
| 5,201,438 | A | 4/1993 | Norwood et al. |
| 5,217,737 | A | 6/1993 | Gygax et al. |
| 5,234,126 | A | 8/1993 | Jonas et al. |
| 5,244,106 | A | 9/1993 | Takacs |
| 5,251,424 | A | 10/1993 | Zenger et al. |
| 5,255,889 | A | 10/1993 | Collette et al. |
| 5,261,544 | A | 11/1993 | Weaver, Jr. |
| 5,279,433 | A | 1/1994 | Krishnakumar et al. |
| 5,281,387 | A | 1/1994 | Collette et al. |
| 5,333,761 | A | 8/1994 | Davis et al. |
| 5,341,946 | A | 8/1994 | Vailliencourt et al. |
| 5,392,937 | A | 2/1995 | Prevot |
| 5,411,699 | A | 5/1995 | Collette et al. |
| 5,454,481 | A | 10/1995 | Hsu |
| 5,472,105 | A | 12/1995 | Krishnakumar et al. |
| 5,472,181 | A | 12/1995 | Lowell |
| RE35,140 | E | 1/1996 | Powers, Jr. |
| 5,484,052 | A | 1/1996 | Pawloski et al. |
| 5,503,283 | A | 4/1996 | Semersky |
| 5,593,063 | A | 1/1997 | Claydon et al. |
| 5,598,941 | A | 2/1997 | Semersky |
| 5,632,397 | A | 5/1997 | Fandeux et al. |
| 5,642,826 | A | 7/1997 | Melrose |
| 5,672,730 | A | 9/1997 | Cottman |
| 5,690,244 | A | 11/1997 | Darr |
| 5,704,504 | A | 1/1998 | Bueno |
| 5,713,480 | A | 2/1998 | Petre et al. |
| 5,730,314 | A | 3/1998 | Wiemann et al. |
| 5,730,914 | A | 3/1998 | Ruppmann, Sr. |
| 5,737,827 | A | 4/1998 | Kuse et al. |
| 5,758,802 | A | 6/1998 | Wallays |
| 5,762,221 | A | 6/1998 | Tobias et al. |
| 5,780,130 | A | 7/1998 | Hansen et al. |
| 5,785,197 | A | 7/1998 | Slat |
| 5,819,507 | A | 10/1998 | Kaneko et al. |
| 5,829,614 | A | 11/1998 | Collette et al. |
| 5,858,300 | A | 1/1999 | Shimizu et al. |
| 5,860,556 | A | 1/1999 | Robbins, III |
| 5,887,739 | A | 3/1999 | Prevot et al. |
| 5,888,598 | A | 3/1999 | Brewster et al. |
| 5,897,090 | A | 4/1999 | Smith et al. |
| 5,906,286 | A | 5/1999 | Matsuno et al. |
| 5,908,128 | A | 6/1999 | Krishnakumar et al. |
| D415,030 | S | 10/1999 | Searle |
| 5,976,653 | A | 11/1999 | Collette et al. |
| RE36,639 | E | 4/2000 | Okhai |

(56) References Cited

U.S. PATENT DOCUMENTS

| | | | |
|---|---|---|---|
| 6,065,624 | A | 5/2000 | Steinke |
| 6,077,554 | A | 6/2000 | Wiemann et al. |
| 6,105,815 | A | 8/2000 | Mazda et al. |
| 6,176,382 | B1 | 1/2001 | Bazlur Rashid |
| 6,213,325 | B1 | 4/2001 | Cheng et al. |
| 6,228,317 | B1 | 5/2001 | Smith et al. |
| 6,230,912 | B1 | 5/2001 | Rashid |
| 6,277,321 | B1 | 8/2001 | Vailliencourt et al. |
| 6,290,094 | B1 | 9/2001 | Arnold et al. |
| 6,298,638 | B1 | 10/2001 | Bettle |
| 6,375,025 | B1 | 4/2002 | Mooney |
| 6,390,316 | B1 | 5/2002 | Mooney |
| 6,413,466 | B1 | 7/2002 | Boyd et al. |
| 6,439,413 | B1 | 8/2002 | Prevot |
| 6,467,639 | B2 | 10/2002 | Mooney |
| 6,485,669 | B1 | 11/2002 | Boyd et al. |
| 6,502,369 | B1 | 1/2003 | Andison et al. |
| 6,514,451 | B1 | 2/2003 | Boyd et al. |
| 6,585,124 | B2 | 7/2003 | Boyd et al. |
| 6,595,380 | B2 | 7/2003 | Silvers |
| 6,612,451 | B2 | 9/2003 | Tobias et al. |
| 6,662,960 | B2 | 12/2003 | Hong et al. |
| 6,749,780 | B2 | 6/2004 | Tobias |
| 6,763,968 | B1 | 7/2004 | Boyd et al. |
| 6,769,561 | B2 | 8/2004 | Futral et al. |
| 6,779,673 | B2 | 8/2004 | Melrose et al. |
| 6,923,334 | B2 | 8/2005 | Melrose et al. |
| 6,942,116 | B2 | 9/2005 | Lisch et al. |
| 6,983,858 | B2 | 1/2006 | Slat et al. |
| 7,051,889 | B2 | 5/2006 | Boukobza |
| 7,077,279 | B2 | 7/2006 | Melrose |
| 7,137,520 | B1 | 11/2006 | Melrose |
| 7,150,372 | B2 | 12/2006 | Lisch et al. |
| 7,159,374 | B2 | 1/2007 | Abercrombie, III et al. |
| 7,520,400 | B2 | 4/2009 | Young et al. |
| 7,717,282 | B2 | 5/2010 | Melrose |
| 8,127,955 | B2 | 3/2012 | Denner et al. |
| 8,152,010 | B2 | 4/2012 | Melrose |
| 2001/0035391 | A1 | 11/2001 | Young et al. |
| 2002/0074336 | A1 | 6/2002 | Silvers |
| 2002/0096486 | A1 | 7/2002 | Bourque et al. |
| 2002/0153343 | A1 | 10/2002 | Tobias et al. |
| 2002/0158038 | A1 | 10/2002 | Heisel et al. |
| 2003/0015491 | A1 | 1/2003 | Melrose et al. |
| 2003/0186006 | A1 | 10/2003 | Schmidt et al. |
| 2003/0196926 | A1 | 10/2003 | Tobias et al. |
| 2003/0217947 | A1 | 11/2003 | Ishikawa et al. |
| 2004/0016716 | A1 | 1/2004 | Melrose et al. |
| 2004/0074864 | A1 | 4/2004 | Melrose et al. |
| 2004/0149677 | A1 | 8/2004 | Slat et al. |
| 2004/0173565 | A1 | 9/2004 | Semersky et al. |
| 2004/0173656 | A1 | 9/2004 | Seong |
| 2004/0211746 | A1 | 10/2004 | Trude |
| 2004/0232103 | A1 | 11/2004 | Lisch et al. |
| 2006/0006133 | A1 | 1/2006 | Lisch et al. |
| 2006/0138074 | A1 | 6/2006 | Melrose |
| 2006/0231985 | A1 | 10/2006 | Kelley |
| 2006/0243698 | A1 | 11/2006 | Melrose |
| 2006/0255005 | A1 | 11/2006 | Melrose et al. |
| 2006/0261031 | A1 | 11/2006 | Melrose |
| 2007/0017892 | A1 | 1/2007 | Melrose |
| 2007/0045312 | A1 | 3/2007 | Abercrombie, III et al. |
| 2007/0051073 | A1 | 3/2007 | Kelley et al. |
| 2007/0084821 | A1 | 4/2007 | Bysick et al. |
| 2007/0125743 | A1 | 6/2007 | Pritchett et al. |
| 2007/0181403 | A1 | 8/2007 | Sheets et al. |
| 2007/0199915 | A1 | 8/2007 | Denner et al. |
| 2007/0199916 | A1 | 8/2007 | Denner et al. |
| 2007/0215571 | A1 | 9/2007 | Trude |
| 2007/0235905 | A1 | 10/2007 | Trude et al. |
| 2008/0047964 | A1 | 2/2008 | Denner et al. |

FOREIGN PATENT DOCUMENTS

| | | |
|---|---|---|
| DE | 17 61 753 | 1/1972 |
| DE | 1761753 | 1/1972 |
| DE | 21 02 319 | 8/1972 |
| DE | 32 15 866 | 11/1983 |
| EP | 0 521 642 | 1/1993 |
| EP | 0 551 788 | 7/1993 |
| EP | 0 666 222 | 8/1995 |
| EP | 0 609 348 | 1/1997 |
| EP | 0 916 406 | 5/1999 |
| EP | 0 957 030 | 11/1999 |
| EP | 1 063 076 | 12/2000 |
| EP | 1565381 | 8/2005 |
| FR | 1571499 | 6/1969 |
| FR | 2607109 | 5/1988 |
| GB | 781103 | 8/1957 |
| GB | 1113988 | 5/1968 |
| GB | 2050919 | 1/1981 |
| GB | 2372977 | 9/2002 |
| GE | 2000-677 | 8/2000 |
| JP | 48-31050 | 9/1973 |
| JP | 49-28628 | 7/1974 |
| JP | 54-72181 | 6/1979 |
| JP | 56-72730 | 6/1981 |
| JP | 55-114717 | 2/1982 |
| JP | 63-189224 | 8/1988 |
| JP | 64-009146 | 1/1989 |
| JP | 03-043342 | 2/1991 |
| JP | 03-076625 | 4/1991 |
| JP | 05-193694 | 8/1993 |
| JP | 06-336238 | 12/1994 |
| JP | 07-300121 | 11/1995 |
| JP | 8053115 | 2/1996 |
| JP | 08-253220 | 10/1996 |
| JP | 09-039934 | 2/1997 |
| JP | 09-110045 | 4/1997 |
| JP | 10-167226 | 6/1998 |
| JP | 10-181734 | 7/1998 |
| JP | 10-230919 | 9/1998 |
| JP | 2000-168756 | 6/2000 |
| JP | 2000-229615 | 8/2000 |
| JP | 2002-127237 | 5/2002 |
| JP | 2006-501109 | 1/2006 |
| NZ | 240448 | 6/1995 |
| NZ | 296014 | 10/1998 |
| NZ | 335565 | 10/1999 |
| NZ | 506684 | 8/2000 |
| NZ | 512423 | 6/2001 |
| NZ | 521694 | 10/2003 |
| RU | 2021956 | 10/1994 |
| RU | 2096288 | 11/1997 |
| WO | WO 93/09031 | 5/1993 |
| WO | WO 93/12975 | 7/1993 |
| WO | WO 94/05555 | 3/1994 |
| WO | WO 97/03885 | 2/1997 |
| WO | WO 97/14617 | 4/1997 |
| WO | WO 97/34808 | 9/1997 |
| WO | WO 99/21770 | 5/1999 |
| WO | WO 00/51895 | 9/2000 |
| WO | WO 01/40081 | 9/2001 |
| WO | WO 02/02418 | 1/2002 |
| WO | WO 02/18213 | 3/2002 |
| WO | WO 02/085755 | 10/2002 |
| WO | WO 2004/028910 | 4/2004 |
| WO | WO 2004/106175 | 12/2004 |
| WO | WO 2004/106176 | 12/2004 |
| WO | WO 2005/012091 | 2/2005 |
| WO | WO 2006/113428 | 10/2006 |
| WO | WO 2007/127337 | 11/2007 |

OTHER PUBLICATIONS

IPRP for PCT/NZ03/00220, completed Jan. 11, 2005.

ISR for PCT/NZ01/000176 (WO 02/018213), mailed Nov. 8, 2001.

ISR for PCT/NZ03/00220, mailed Nov. 27, 2003.

Notice of Rejection of Japanese Patent Application No. 2002-523347, dated May 24, 2011.

(56) References Cited

OTHER PUBLICATIONS

Notice of Rejection of Japanese Patent Application No. 2002-523347, dated May 29, 2012.
National Intellectual Property Center of Georgia "SAKPATENTI", Search Report in Filing No. 8770/01, Application No. AP2003 008770, GE19049, Mar. 1, 2006.
IPRP with Written Opinion for PCT/US2004/024581, dated Jan. 30, 2006.
IPRP with Written Opinion for PCT/US2007/010182, Oct. 28, 2008.
IPRP with Written Opinion for PCT/US2004/016405; completed Nov. 25, 2005.
ISR for PCT/US2004/024581, Jul. 25, 2005.
ISR for PCT/US2007/010182, Oct. 19, 2007.
Article 94(3) EPC Communication for EP2354018, dated Oct. 30, 2014, 4 pages.

CONTAINER STRUCTURE FOR REMOVAL OF VACUUM PRESSURE

CROSS-REFERENCE TO RELATED APPLICATIONS

The present application is a continuation of U.S. patent application Ser. No. 11/704,338, filed Feb. 9, 2007, now U.S. Pat. No. 8,127,955, which is a continuation-in-part of U.S. patent application Ser. No. 10/529,198, filed Dec. 15, 2005, now U.S. Pat. No. 8,152,010, which claims priority of International Application No. PCT/NZ2003/000220, filed Sep. 30, 2003, which in turn claims priority of New Zealand Patent Application No. 521694, filed Sep. 30, 2002. U.S. patent application Ser. No. 11/704,338, is also a continuation-in-part of U.S. patent application Ser. No. 11/432,715, filed on May 12, 2006, now U.S. Pat. No. 7,717,282, which is a continuation of U.S. patent application Ser. No. 10/363,400, filed on Feb. 26, 2003, now U.S. Pat. No. 7,077,279, which is the U.S National Phase of PCT/NZ01/00176, filed on Aug. 29, 2001, which in turn claims priority to New Zealand Patent Application No. 506684, filed on Aug. 31, 2000, and New Zealand Patent Application No. 512423, filed on Jun. 15, 2001. The entire contents of the aforementioned applications, patents and publications are incorporated herein by reference.

TECHNICAL FIELD OF THE INVENTION

This invention relates generally to a container structure that allows for the removal of vacuum pressure. This is achieved by inverting a transversely oriented vacuum pressure panel located in the lower end-wall, or base region of the container.

BACKGROUND OF THE INVENTION

So called "hot-fill" containers are well known in the prior art, whereby manufacturers supply PET containers for various liquids which are filled into the containers while the liquid product is at an elevated temperature, typically at or around 85 degrees C. (185 degrees F.). The container is typically manufactured to withstand the thermal shock of holding a heated liquid, resulting in a "heat-set" plastic container. This thermal shock is a result of either introducing the liquid hot at filling, or heating the liquid after it is introduced into the container.

Once the liquid cools down in a capped container, however, the volume of the liquid in the container reduces, creating a vacuum within the container. This liquid shrinkage results in vacuum pressures that pull inwardly on the side and end walls of the container. This in turn leads to deformation in the walls of plastic bottles if they are not constructed rigidly enough to resist such forces.

Typically, vacuum pressures have been accommodated by the use of vacuum panels, which distort inwardly under vacuum pressure. Prior art reveals many vertically oriented vacuum panels that allow containers to withstand the rigors of a hot-fill procedure. Such vertically oriented vacuum panels generally lie parallel to the longitudinal axis of a container and flex inwardly under vacuum pressure toward this longitudinal axis. In addition to the vertically oriented vacuum panels, many prior art containers also have flexible base regions to provide additional vacuum compensation. Many prior art containers designed for hot-filling have various modifications to their end-walls, or base regions, to allow for as much inward flexure as possible to accommodate at least some of the vacuum pressure generated within the container.

All such prior art, however, provides for flat or inwardly inclined, or recessed base surfaces. These have been modified to be susceptible to as much further inward deflection as possible. As the base region yields to the force, it is drawn into a more inclined position than prior to having vacuum force applied.

Unfortunately, however, the force generated under vacuum to pull longitudinally on the base region is only half that force generated in the transverse direction at the same time. Therefore, vertically oriented vacuum panels are able to react to force more easily than a panel placed in the base. Further, there is a lot more surface area available around the circumference of a container than in the end-wall. Therefore, adequate vacuum compensation can only be achieved by placing vertically-oriented vacuum panels over a substantial portion of the circumferential wall area of a container, typically 60% of the available area. Even with such substantial displacement of vertically-oriented panels, however, the container requires further strengthening to prevent distortion under the vacuum force.

The liquid shrinkage derived from liquid cooling causes a build up of vacuum pressure. Vacuum panels deflect toward this negative pressure, to a degree lessening the vacuum force, by effectively creating a smaller container to better accommodate the smaller volume of contents. However, this smaller shape is held in place by the generating vacuum force. The more difficult the structure is to deflect inwardly, the more vacuum force will be generated.

In prior art, a substantial amount of vacuum is still present in the container and this tends to distort the overall shape unless a large, annular strengthening ring is provided in horizontal, or transverse, orientation at least one-third of the distance from an end to the container. Considering this, it has become accepted knowledge to believe that it is impossible to provide for full vacuum compensation through modification to the end-wall or base region alone. The base region offers very little surface area, compared to the side walls, and reacts to force at half the rate of the side walls.

Therefore it has become accepted practice to only expect partial assistance to the overall vacuum compensation to be generated through the base area. Further, even if the base region could provide for enough flexure to accommodate all liquid shrinkage within the container, there would be a significant vacuum force present, and significant stress on the base standing ring. This would place force on the sidewalls also, and to prevent distortion, the smooth sidewalls would have to be much thicker in material distribution, be strengthened by ribbing or the like, or be placed into shapes more compatible to mechanical distortion (for example, be square instead of circular).

For this reason it has not been possible to provide container designs in plastic that do not have typical prior art vacuum panels that are vertically oriented on the sidewall. Many manufacturers have therefore been unable to commercialize plastic designs that are the same as their glass bottle designs with smooth sidewalls.

U.S. Pat. No. 6,595,380 to Silvers claims to provide for full vacuum compensation through the base region without requiring positioning of vertically oriented vacuum panels on the smooth sidewalls. This is suggested by combining techniques well-known and practiced in the prior art. Silvers provides for a slightly inwardly domed, and recessed base region to provide further inward movement under vacuum pressure. However, the technique disclosed, and the stated percentage areas required for efficiency, are not considered by the present applicant to provide a viable solution to the problem. In fact, flexure in the base region is recognized to be greatest in a horizontally flat base region, and maximizing such flat portions on the base has been well practiced and found to be unable to provide enough vacuum compensation to avoid also employing vertically oriented vacuum panels.

Silvers does provide for the base region to be strengthened by coupling it to the standing ring of the container, in order to assist preventing unwanted outward movement of the inwardly inclined or flat portion when a heated liquid builds up initial internal pressure in a newly filled and capped container. This coupling is achieved by rib structures, which also serve to strengthen the flat region. Whilst this may strengthen the region in order to allow more vacuum force to be applied to it, the ribs conversely further reduce flexibility within the base region, and therefore reduce flexibility. It is believed by the present applicant that the specific "ribbed" method proposed by Silvers could only provide for approximately 35% of the vacuum compensation that is required, as the modified end-wall is not considered capable of sufficient inward flexure to fully account for the liquid shrinkage that would occur. Therefore a strong maintenance of vacuum pressure is expected to occur. Containers employing such base structure therefore still require significant thickening of the sidewalls, and as this is done the base region also becomes thicker during manufacturing. The result is a less flexible base region, which in turn also reduces the efficiency of the vacuum compensation achieved. The present invention relates to a hot-fill container which is a development of the hot-fill container described in our International Publication No. WO 2002/0018213 (the "PCT Application"), which is incorporated herein by reference in its entirety. The PCT Application describes the background of hot-fill containers and the problems with the designs that were overcome or at least ameliorated by the design disclosed in the PCT Application.

In the PCT Application, a semi-rigid container was provided that had a substantially vertically folding vacuum panel portion. Such a transversely oriented vacuum panel portion included an initiator portion and a control portion which generally resisted being expanded from the collapsed state. Further described in the PCT Application is the inclusion of vacuum panels at various positions along the container wall.

A problem exists when locating such a panel in the end-wall or base region, whereby stability may be compromised if the panel does not move far enough into the container to no longer form part of the container touching the surface the container stands on. A further problem exists when utilizing a transverse panel in the base end-wall due to the potential for shock deflection of the inverted panel when a full and capped container is dropped. This may occur on a container with soft and unstructured walls that is dropped directly on its side. The shock deflection of the sidewalls causes a shock-wave of internal pressure that acts on the panel. In such cases improved panel configurations are desired that further prevent panel roll-out, or initiator region configurations utilized that optimize for resistance to such reversion displacement.

SUMMARY OF THE INVENTION

According to one exemplary embodiment, the present invention relates to a container having a longitudinal axis, and comprising: an upper portion including an opening into the container; a sidewall portion extending from the upper portion to a lower portion, the lower portion including a base; and a pressure panel located in the lower portion substantially transversely to the longitudinal axis, the pressure panel being movable substantially along the longitudinal axis between an initial position and an inverted position to compensate for a change of pressure induced within the container; wherein the pressure panel comprises an initiator portion and a control portion, the initiator portion adapted to move in response to the change of pressure prior to the control portion.

According to another exemplary embodiment, the present invention relates to a container having a longitudinal axis, and comprising: an upper portion including an opening into the container; a sidewall portion extending from the upper portion to a lower portion, the lower portion including a base; a pressure panel located in the lower portion substantially transversely to the longitudinal axis, the pressure panel being movable substantially along the longitudinal axis between an initial position and an inverted position to compensate for a change of pressure induced within the container; wherein when in the initial position, at least a portion of the pressure panel defines an angle of inclination with respect to a plane orthogonal to the longitudinal axis that is greater than about 15 degrees.

According to yet another exemplary embodiment, the present invention relates to a container having a longitudinal axis, and comprising: an upper portion including an opening into the container; a sidewall portion extending from the upper portion to a lower portion, the lower portion including a base; a pressure panel located in the lower portion substantially transversely to the longitudinal axis, the pressure panel being movable substantially along the longitudinal axis between an initial position and an inverted position to compensate for a change of pressure induced within the container; and a hinge structure connecting the pressure panel to the lower portion; wherein the pressure panel moves from the initial position to the inverted position in response to internal vacuum forces developed within the container as a result of cooling of liquid contents within the container.

Further aspects of the invention which should be considered in all its novel aspects will become apparent from the following description.

DETAILED DESCRIPTION OF PREFERRED EMBODIMENTS

Figure 1:
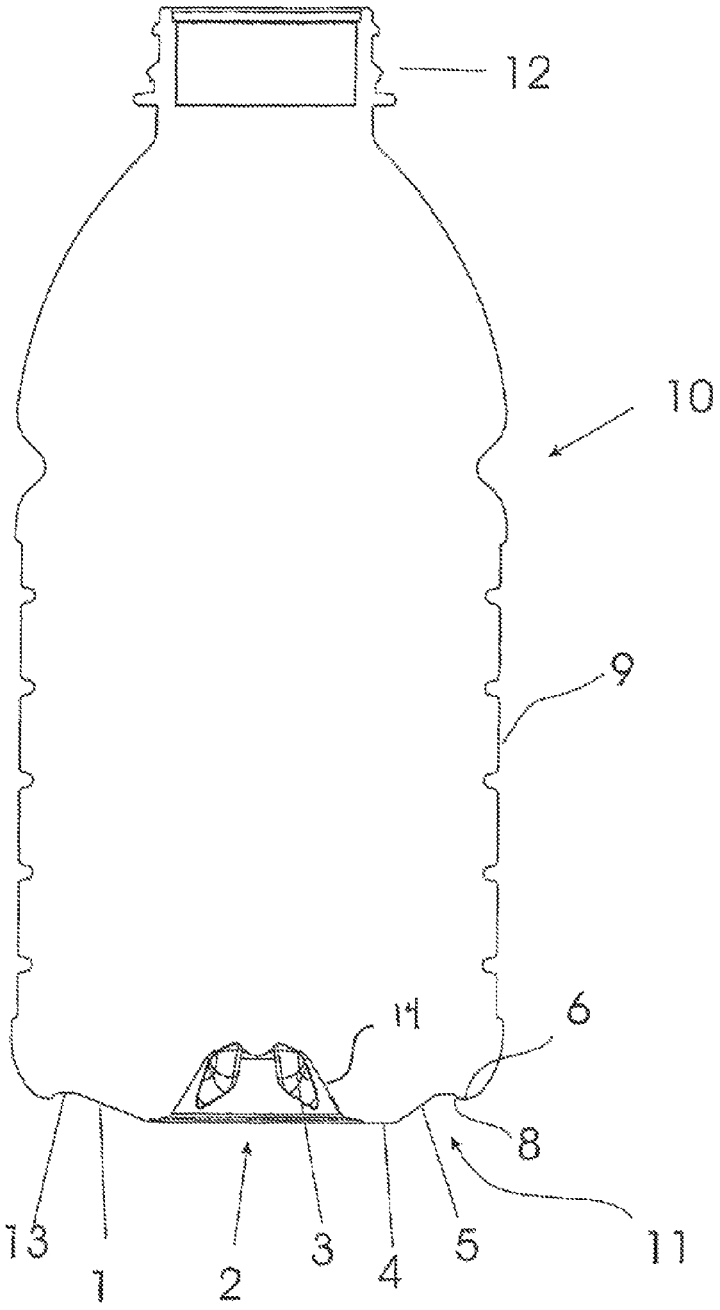
FIG. 1: shows a cross-sectional view of a hot-fill container according to one possible embodiment of the invention in its pre-collapsed condition.

The following description of preferred embodiments is merely exemplary in nature, and is in no way intended to limit the invention or its application or uses. As discussed above, to accommodate vacuum forces during cooling of the contents within a heat set container, containers have typically been provided with a series of vacuum panels around their sidewalls and an optimized base portion. The vacuum panels deform inwardly, and the base deforms upwardly, under the influence of the vacuum forces. This prevents unwanted distortion elsewhere in the container. However, the container is still subjected to internal vacuum force. The panels and base merely provide a suitably resistant structure against that force. The more resistant the structure is, the more vacuum force will be present. Additionally, end users can feel the vacuum panels when holding the containers.

Typically at a bottling plant, the containers will be filled with a hot liquid and then capped before being subjected to a cold water spray resulting in the formation of a vacuum within the container which the container structure needs to be able to cope with. The present invention relates to hot-fill containers and a structure that provides for the substantial removal or substantial negation of vacuum pressure. This allows much greater design freedom and light weighting opportunities as there is no longer any requirement for the structure to be resistant to vacuum forces which would otherwise mechanically distort the container. As mentioned above and in the PCT Application, various proposals for hot-fill container designs have been put forward.

Further development of the hot-fill container of the PCT Application has positioned an outwardly inclined and transversely oriented vacuum panel between the lower portion of the side wall and the inwardly domed base region. In this position, the container has poor stability, insofar as the base region is very narrow in diameter and does not allow for a good standing ring support. Additionally, there is preferably provided a decoupling structure that provides a hinge joint to the juncture of the vacuum panel and the lower sidewall. This decoupling structure provides for a larger range of longitudinal movement of the vacuum panel than would occur if the panel was coupled to the side wall by way of ribs, for example. One side of the decoupling structure remains adjacent the sidewall, allowing the opposite side of the decoupling structure adjacent to an initiator portion to bend inwardly and upwardly. The decoupling structure therefore provides for increased deflection of the initiator portion, allowing increased movement of the panel portion longitudinally away from the previously outwardly inclined position, enabling the panel portion to fold inwardly relative to the container and upwardly relative to the initial base position. The lower sidewall is therefore subjected to lower force during such inversion. During this action, the base portion is translated longitudinally upward and into the container.

Further, as the panel portion folds inwardly and upwardly, the decoupling structure allows for the vacuum panel to now form part of the container base portion. This development has at least two important advantages. Firstly, by providing the vacuum panel so as to form part of the base after folding, a mechanical force can now be provided immediately against the panel in order to apply inverting force. This allows much greater control Over the action, which may, for example, be applied by a mechanical pusher, which would engage with the container base in resetting the container shape. This allows increased design options for the Initiator portion. Secondly, the transversely oriented vacuum panel is effectively completely removed from view as it is forced from an outward position to an inward position. This means that there are no visible design features being imposed on the major portion of the side wall of the container in order to incorporate vacuum compensation. If required therefore, the major portion of the side wall of the present invention could have no structural features and the container could, if required, replicate a clear wall glass container. Alternatively, as there will be little or no vacuum remaining in the container after the panel is inverted, any design or shape can now be utilized, without regard for integrity against vacuum forces found in other hot-fill packages. Such a maneuver allows for a wide standing ring to be obtained. The decoupling structure provides for the panel to become displaced longitudinally so that there is no contact between any part of the panel or upwardly domed base portion with the contact surface below. A standing ring is then provided by the lower sidewall immediately 20 adjacent the decoupling structure. Further, by gaining greater control over the inverting motion and forces, it is possible to allow the initiator portion to share the same steep angle as the control portion. This allows for increased volume displacement during inversion and increased resistance to any reversion back to the original position.

Referring to the accompanying drawings, FIG. 1 shows, by way of example only, and in a diagrammatic cross-sectional view, a container in the form of a bottle. This is referenced generally by arrow 10 with a typical neck portion 12 and a side wall 9 extending to a lower portion of the side wall 11 and an underneath base portion 2. The container 10 will typically be blow molded from any suitable plastic material but typically this will be polyethylene terephthalate (PET). The base 2 is shown provided with a plurality of reinforcing ribs 3, although this is merely by way of example only.

Figure 2:
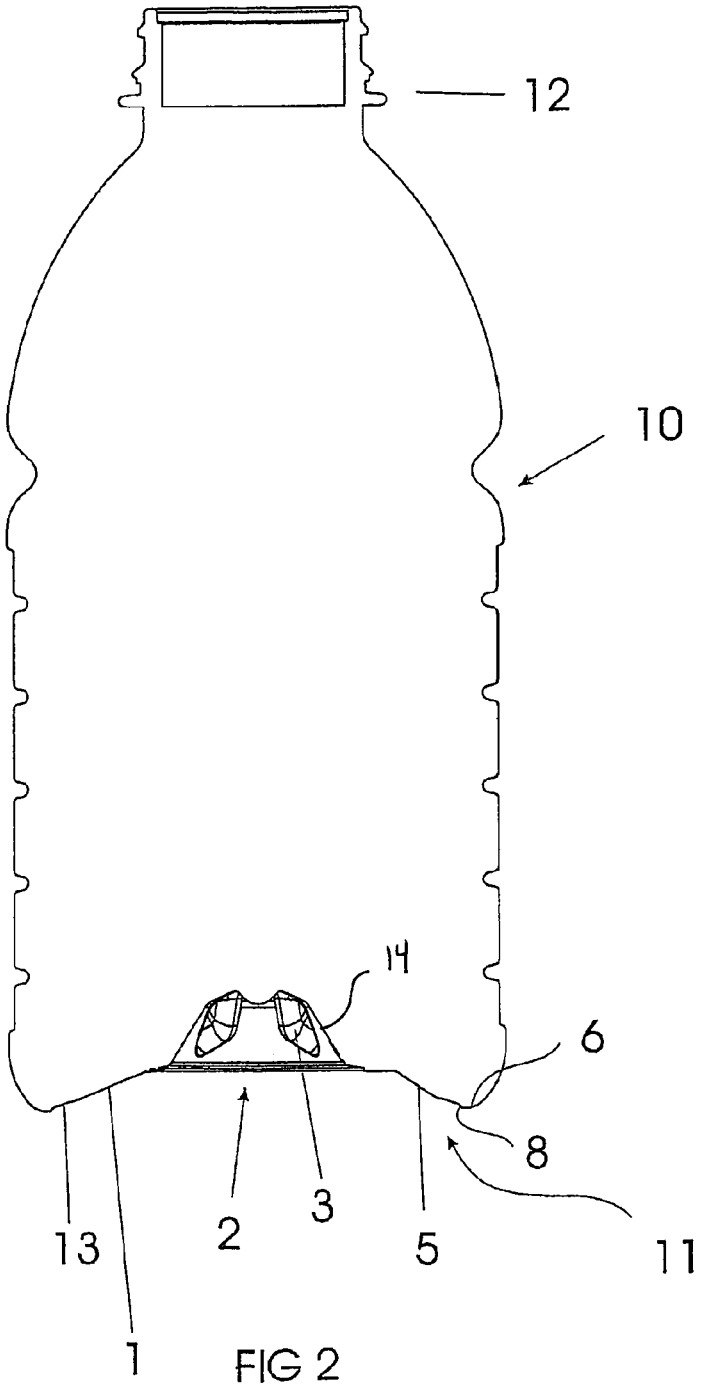
FIG. 2: shows the container of FIG. 1 in its collapsed position.

In FIG. 1 the lower side wall portion 11, which operates as a pressure panel, is shown in its unfolded position so that a ring or annular portion 6 is positioned above the level of the bottom of the base 2 which is forming the standing ring or support 4 for the container 10. In FIG. 2, the lower side wall portion 11 is shown having folded inwardly so that the ring or annular portion 6 is positioned below the level of the bottom of the base 2 and is forming the new standing ring or support for the container 10. The pressure panel 11 can include a centrally located push-up portion 14.

Figure 3:
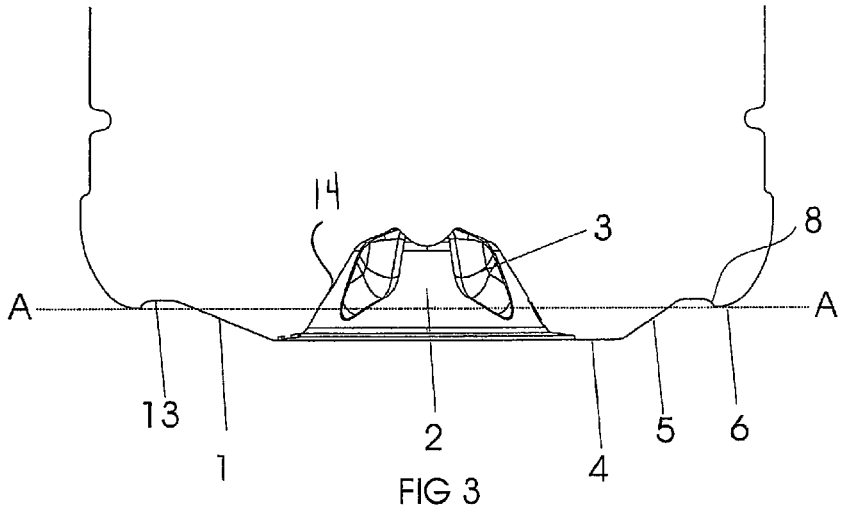
FIG. 3: shows the base of FIG. 1 before collapsing.
Figure 4:
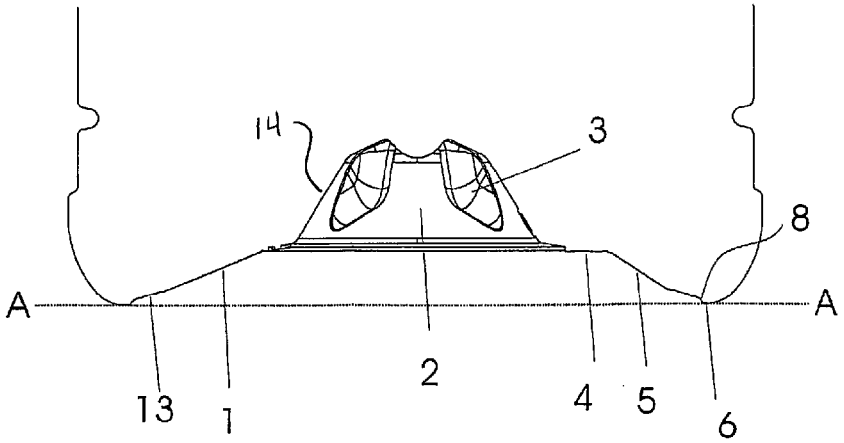
FIG. 4: shows the base of FIG. 2 following collapsing.

To assist this occurring, and as will be seen particularly in FIGS. 3 and 4, immediately adjacent the ring or annular portion 6 there may be an instep or recess 8 and decoupling structure 13, in this case a substantially flat, non-ribbed region, which after folding enables the base portion 2 to effectively completely disappear within the bottom of the container and above the line A-A. Many other configurations for the decoupling structure 13 are envisioned, however.

Figure 5:
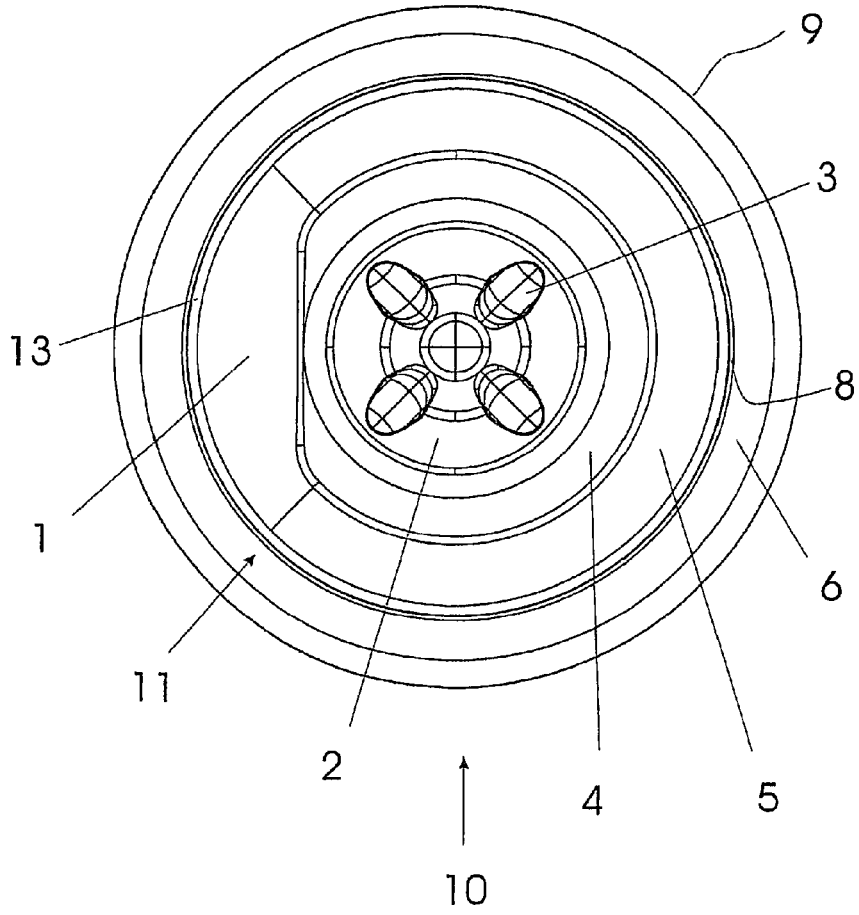
FIG. 5: shows a bottom view of the base of the container of FIG. 1 before collapsing.

Referring now particularly to FIG. 5, the base 2 with its strengthening ribs 3 is shown surrounded by the bottom annular portion 11 of the side wall 9 and the decoupling structure 13. The lower side wall portion 11 is shown in this particular embodiment as having an initiator portion 1 which forms part of the collapsing or inverting section which yields to a longitudinally-directed collapsing force before the rest of the collapsing or folding section. The base 2 is shown provided within the typical base standing ring 4, which will be the first support position for the container 10 prior to the inversion of the folding panel. Associated with the initiator portion 1 is a control portion 5 which in this embodiment is a more steeply angled inverting section which will resist expanding from the collapsed state. Forming the outer perimeter of the bottom portion 11 of the side wall 9 is shown the side wall standing ring or annular portion 6 which, following collapsing of the panel 11, will provide the new container support.

To allow for increased evacuation of vacuum it will be appreciated that it is preferable for at least a portion of the pressure panel 11 (e.g., the control portion 5) to have a steep angle of inclination. For example, as shown in the exemplary embodiment of FIG. 6, the control portion 5 may be set at an angle θwith respect to a plane orthogonal to the container's longitudinal axis A, or using the longitudinal axis A as the reference, the angle theta plus 90 degrees (see, for example, the angle "x" illustrated in FIG. 13*b* referenced with respect to a longitudinal axis A' using the axis reference illustrated in FIGS. 13*b* and 13*c*). According to one exemplary embodiment, the angle θof the control portion may be set at about 10 degrees or more, or 100 degrees or more relative to the longitudinal axis. According to yet another exemplary embodiment, the angle θof the control portion may be set at about 15 degrees or more, or 105 degrees or more relative to the longitudinal axis. According to yet another exemplary embodiment, the angle θmay be in the range of about 30 degrees to about 45 degrees, or in a range of about 120 degrees to about 135 degrees relative to the longitudinal axis. The initiator portion 1 can be inclined at a lesser angle of, for example, at least about 10 degrees less than the control portion. By way of example, it will be appreciated that when the panel 11 is inverted by mechanical compression it will undergo an angular change that is double that provided to it. For example, if the conical control portion 5 is set at about 15 degrees in the initial position (or at an angle "y" of about 105 degrees relative to a longitudinal axis A" using the axis reference illustrated in FIGS. 13*b* and 13*c*), it can provide an angular change of approximately 30 degrees when moved to the inverted position. As further illustrated in FIG. 13*c*, at least a portion of centrally-located push-up 50 may be inclined at an angle "z" relative to a longitudinal axis A"'.

Figure 6:
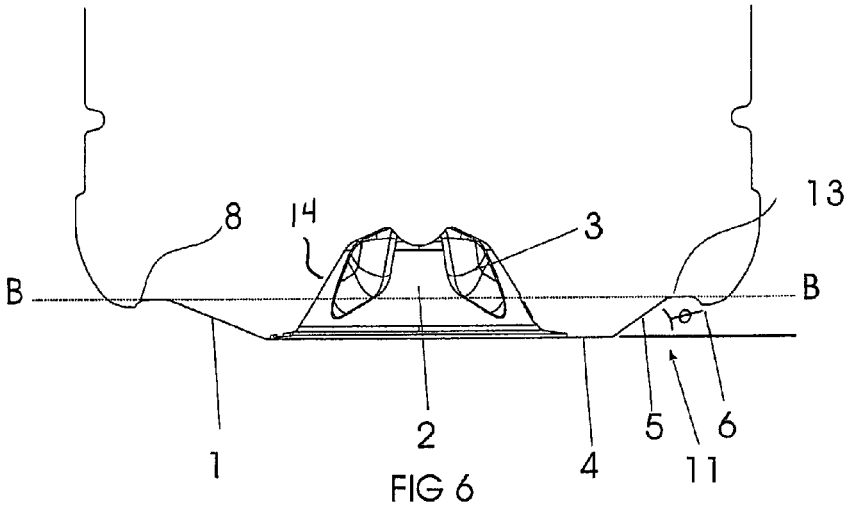
FIG. 6: shows the base of FIG. 1 before collapsing.
Figure 7:
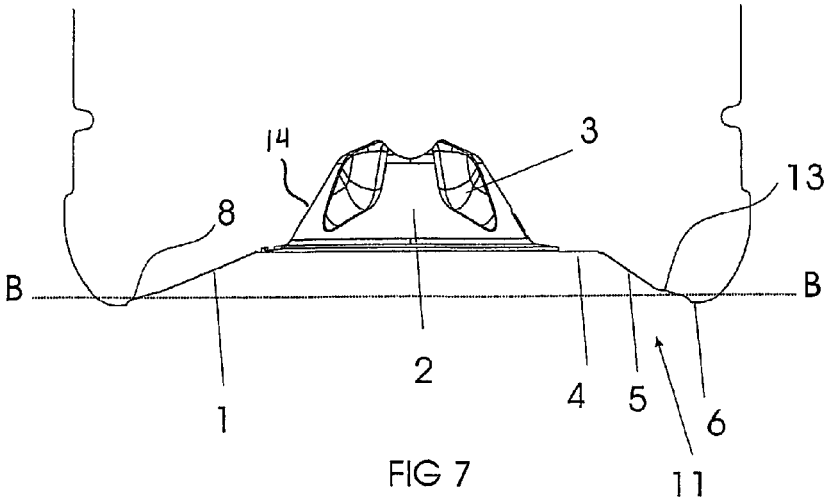
FIG. 7: shows the base of FIG. 2 following collapsing.
Figure 6A:
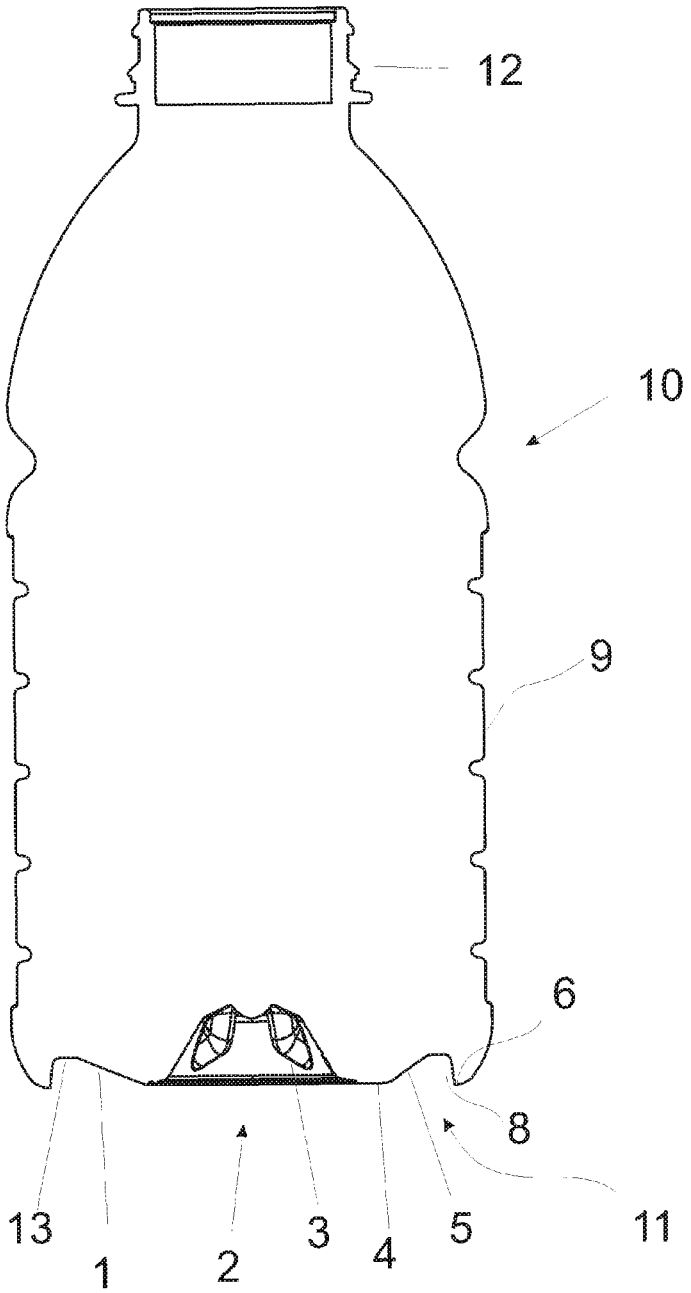
FIG. 6*a*: shows an alternative container configuration.

Referring to FIGS. 6 and 7, according to another exemplary embodiment, the control portion 5 may be initially set at an outwardly inclined angle θof approximately 35 degrees, which will provide an angular inversion of approximately 70 degrees. According to this exemplary embodiment, the initiator portion can be initially set at an outward angle of approximately 20 degrees. As a further example referring to FIG. 6A, the base 2 may be recessed to such an extent that the entire lower sidewall portion and base are substantially or completely contained horizontally above the standing ring 6 even prior to folding of the pressure panel 11. Preferably the pressure panel 11 includes a portion inclined outwardly at an angle of greater than 10 degrees relative to a plane orthogonal to a longitudinal axis of the container when the pressure panel is in the initial position, or about 100 degrees relative to the longitudinal axis, and much steeper angles such as those described herein may be used.

Figure 8A:
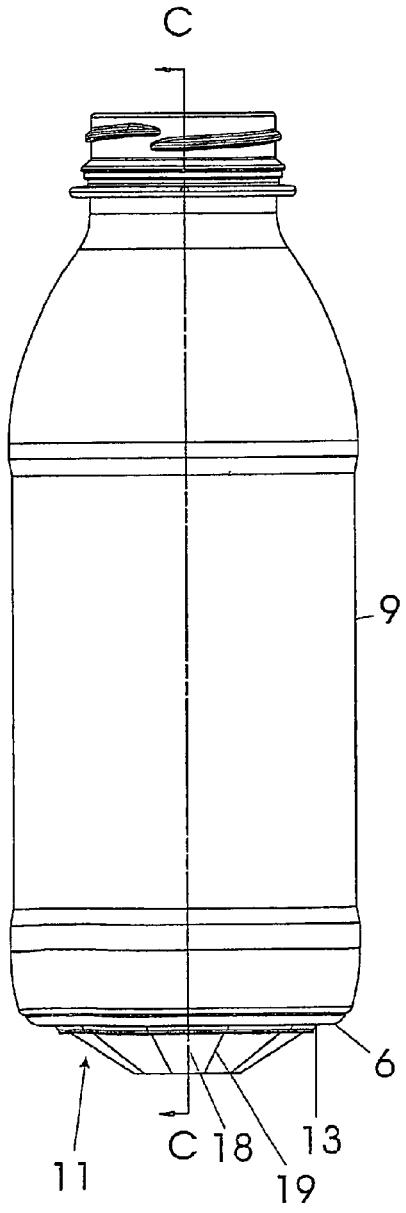
FIG. 8*a* shows a cross-sectional view of a hot-fill container according to an alternative embodiment of the invention in its pre-collapsed condition.
Figure 8B:
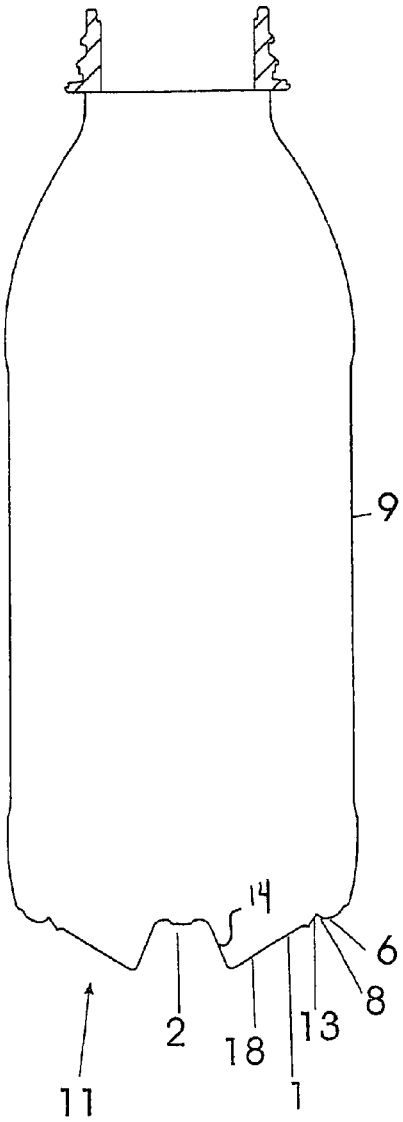
FIG. 8*b*: shows a cross-sectional view of the container shown in FIGS. 8*a* and 9 through line C-C.

Referring to FIGS. 8*a* and 8*b*, where the same reference numerals have been used where appropriate as previously, it is envisioned that in exemplary embodiments of this invention, the initiator portion may be reconfigured so that control portion 18 would provide essentially a continuous conical area about the base 2. As a result, the initiator portion 1 and the control portion 5 will be at a common angle of inclination, such that they form a uniformly inclined panel portion. However, initiator portion 1 may still be configured to provide the area of least resistance to inversion, such that although it shares the same angular of inclination as the control portion 18, it still provides an initial area of collapse or inversion. In this exemplary embodiment, initiator portion 1 causes the pressure panel 11 to begin inversion from the widest diameter adjacent the decoupling structure 13. In this exemplary embodiment, the container side walls 9 can be "glass-like" in construction in that there are no additional strengthening ribs or panels as might be typically found on a container, particularly if required to withstand the forces of vacuum pressure. Additionally, structures may be added to the conical portions of the vacuum panel 11 in order to add further control over the inversion process. For example, the conical portion of the vacuum panel 11 may be divided into fluted regions.

Figure 9:
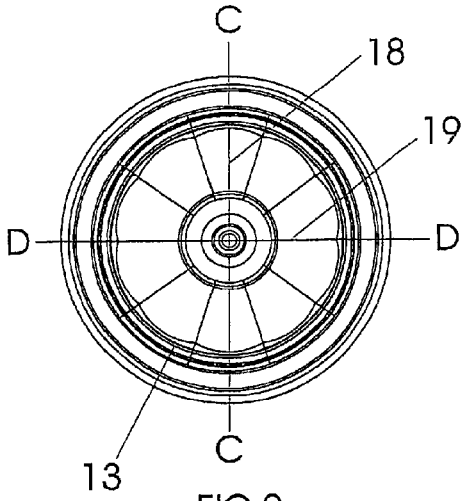
FIG. 9: shows a bottom view of the base of the container of FIGS. 8*a* and 8*b* and FIG. 10 before collapsing.
Figure 10:
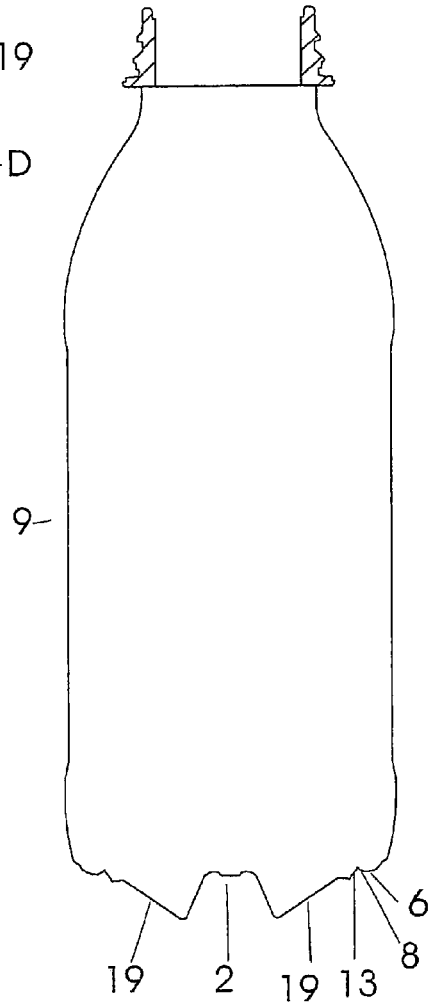
FIG. 10: shows a cross-sectional view of the container shown in FIG. 9 through line D-D.

Referring specifically to FIGS. 8*a* and 9, the panel portions can be outwardly convex, and evenly distributed around the central axis to create alternating regions of greater angular inclination 19 and regions of lesser angular inclination 18. This configuration may provide greater control over inversion of the panel. This type of geometry can provide increased resistance to reversion of the panel from the inverted position back to the initial position. Also, this type of geometry can provide a more even distribution of forces when the panel is in the inverted position.

Referring to FIGS. 15*a-d* and 17*a-d*, convex or downwardly outwardly-projecting flutes are shown. However, concave or inwardly-directed fluting arrangements are also possible. The embodiment having inwardly-directed flutes may offer less resistance to initial is inverting forces, coupled with increased resistance to forces tending to revert the panel back to the initial position. In this way, the inwardly-directed flutes can behave in much the same manner as ribs to prevent the panel from being forced back out to the initial, outwardly-projecting position, but allow for hinge movement from the initial, outwardly-projecting position to the inwardly-directed position.

The inwardly-directed or outwardly-projecting flutes or projections can function as ribs to increase the force required to invert the panel. It will be appreciated by one of ordinary skill in the art, that the forces applied to invert the panel will be sufficient to overcome any flute- or rib-strengthened panel, and that once the panel is inverted, the panel will be very resistant to reversion to the initial position, for example, if the container is dropped or shocked.

Figure 16A:
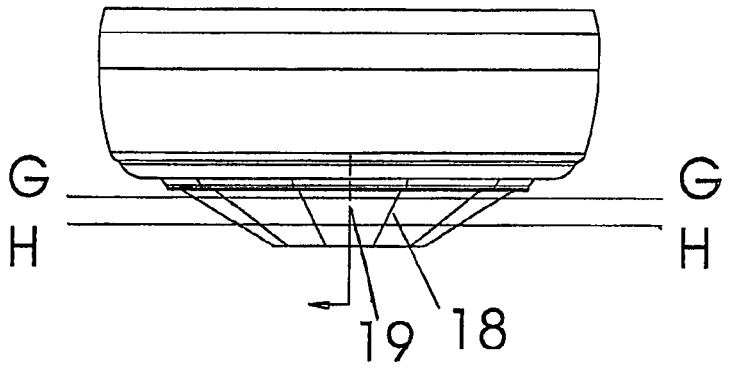
FIG. 16*a*: shows a side view of a container of FIG. 16*c* according to an alternative embodiment including inwardly projecting fluting through Line I-I.
Figure 16B:
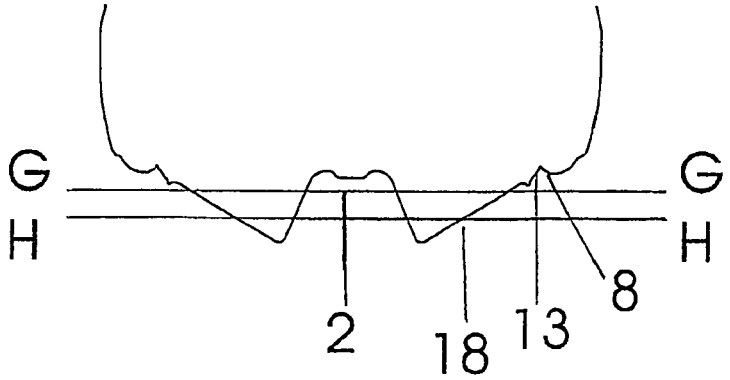
FIG. 16*b*: shows a cross-sectional view of the base of the container of FIG. 16*c* through Line J-J.
Figure 16C:
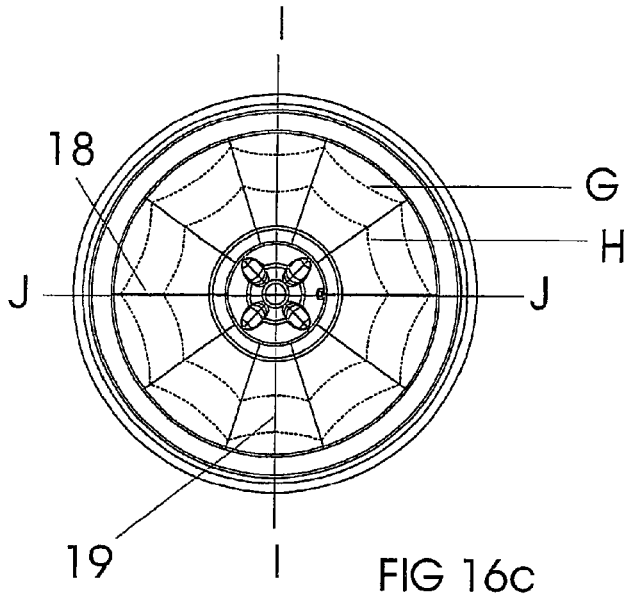
FIG. 16*c*: shows a bottom view of the base of the container of FIGS. 16*a* and 16*b* with dotted contour section lines through lines G-G and H-H.
Figure 16D:
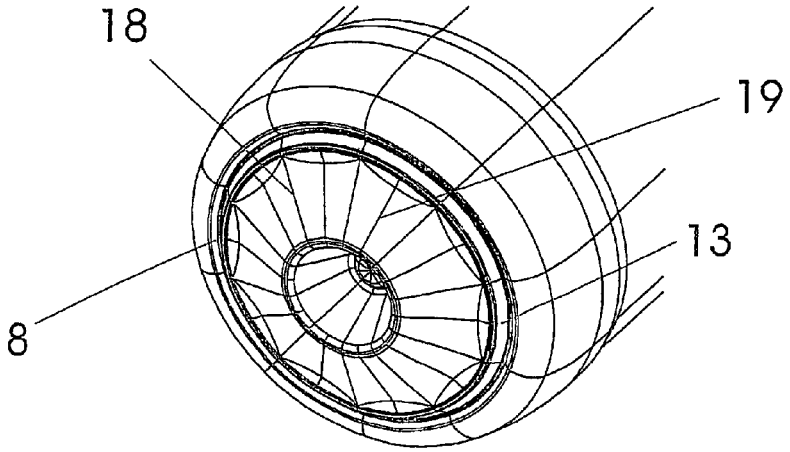
FIG. 16*d*: shows a perspective view of the base of the container of FIGS. 16*a-c;*
Figure 17A:
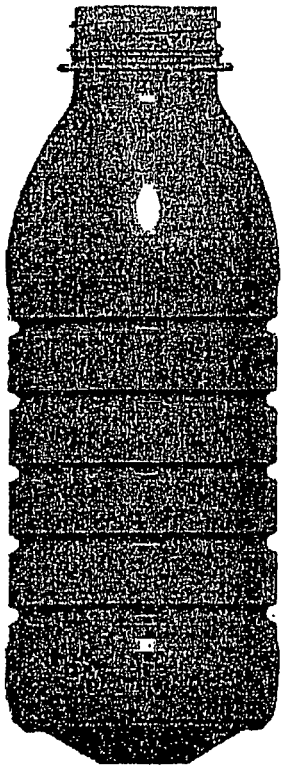
FIGS. 17*a-d*: show side, side perspective, end perspective, and end views respectively of the container of FIG. 15.
Figure 17B:
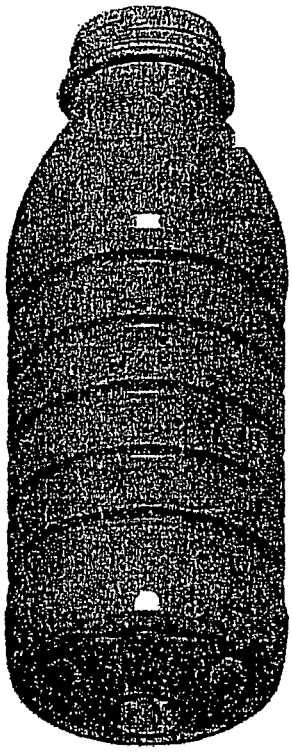
Figure 17C:
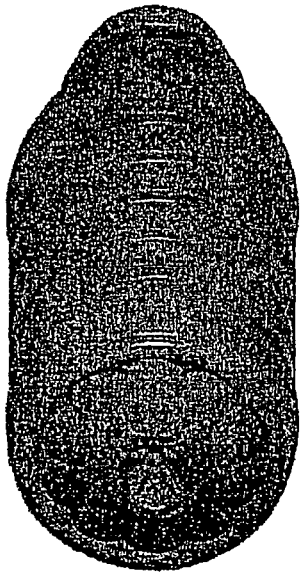
Figure 17D:
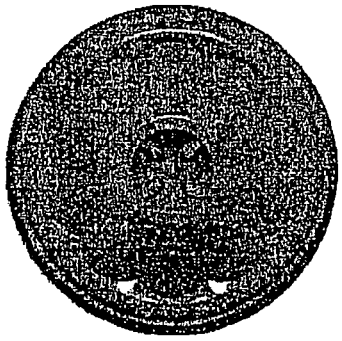
Figure 18A:
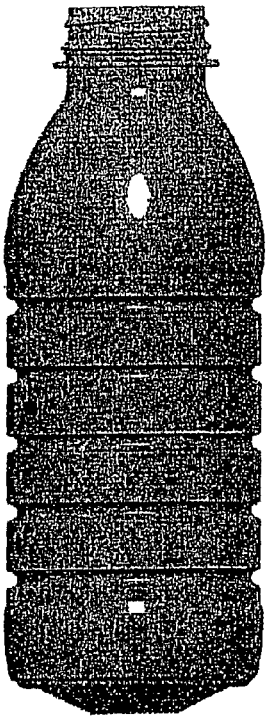
FIGS. 18*a-d*: show side, side perspective, end perspective, and end views respectively of the container of FIG. 16.
Figure 18B:
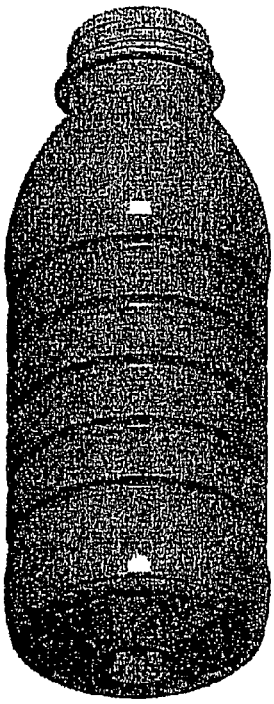
Figure 18C:
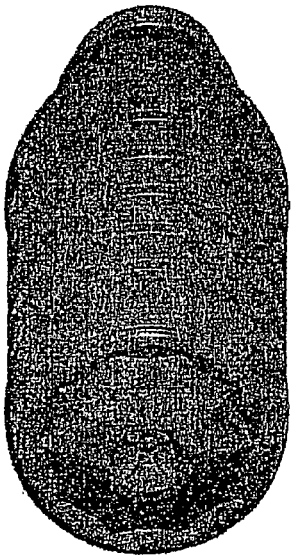
Figure 18D:
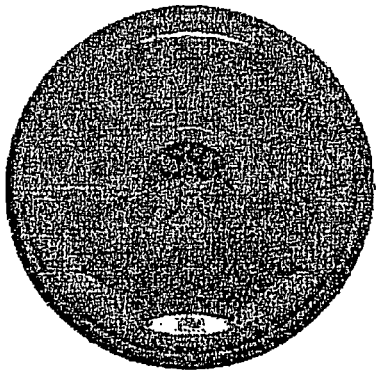

Referring to FIGS. 16*a-d* and 18*a-d*, concave or inwardly-projecting flutes are shown, with the contour lines G and H of FIG. 16*c* illustrating this concavity through two cross-sectional reliefs. Further embodiments comprising arrays utilizing both concave and convex flutes are also intended within the scope of the invention.

Figures 11A, 11B, 11C, 11D:
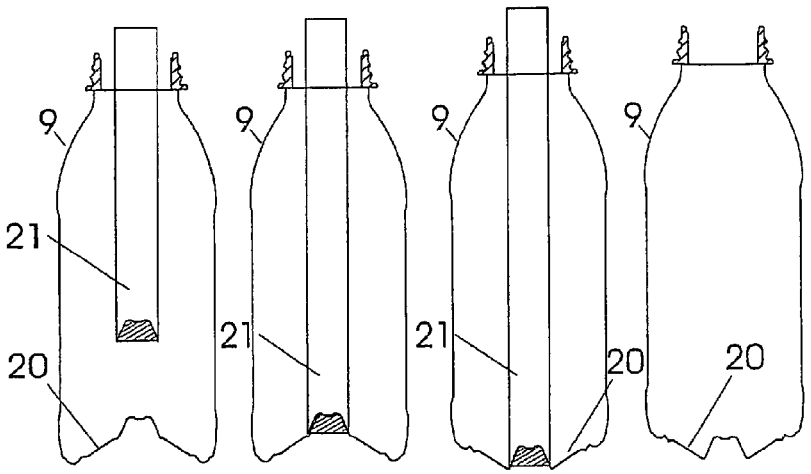
FIGS. 11*a-d*: show cross-sectional views of the container according to an alternative embodiment of the invention incorporating a pusher to provide panel folding.

Referring to the exemplary embodiment of FIGS. 11*a-d*, the container may be blow molded with the pressure panel 20 in the inwardly or upwardly inclined position. As shown in FIG. 11*d*, a force can be imposed on the folding panel 20 (e.g., by means of a mechanical pusher 21 introduced through the neck region and forced downwardly) in order to place the panel in the outwardly inclined position prior to use as a vacuum container. Following the filling, capping, and cooling of the container (e.g., through the use of cold water spray), a vacuum is created within the filled container. As shown in FIGS. 12*a*-12*d*, a force can be imposed on the folding panel 20 in order to force the panel from the initial, outwardly-inclined position to an inwardly-inclined position. For example, the force can be applied by means of a mechanical pusher 22 or some other external device creating relative movement of the bottle base relative to a punch or the like. Alternatively, the panel 20 can be configured to invert from the initial, outwardly-inclined position to the inverted, inwardly-projecting position solely under the force of the internal vacuum developed within the container. For example, a portion of the panel can be initially resilient enough such that the panel inverts solely under the internal vacuum forces.

Due to the inversion of the panel, any deformation of the container shape due to the internal vacuum can be restored as a result of the internal volume reduction in the container. The vacuum within the container is removed as the inversion of the panel causes a rise in pressure. Such a rise in pressure can reduce vacuum pressure until ambient pressure is reached or even a slightly positive pressure is achieved.

Figures 12A, 12B, 12C, 12D:
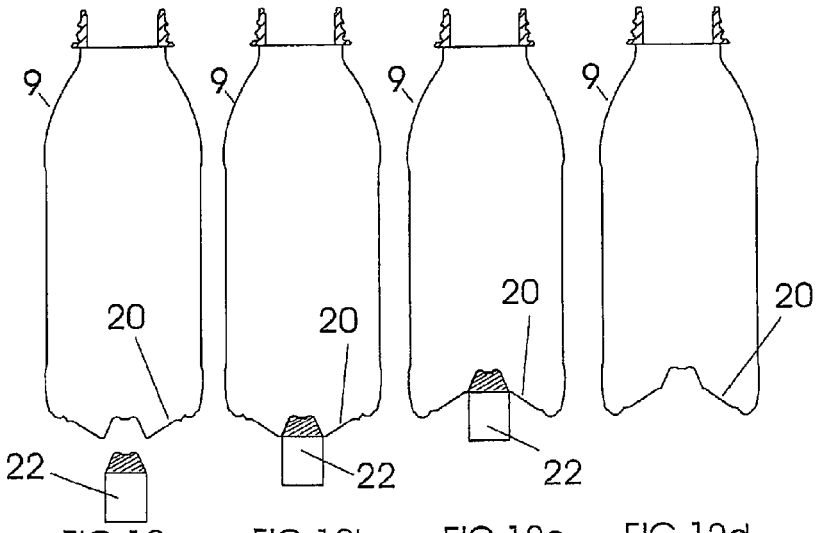
FIGS. 12*a-d*: show cross-sectional views of the container according to a further alternative embodiment of the invention incorporating a pusher to provide panel folding.

It will be appreciate that in another exemplary embodiment of the invention, the panel may be inverted in the manner shown in FIGS. 12*a-d* in order to provide accommodate internal forces such those developed during pasteurization and the like. In such a way, the panel can provide relief against the internal pressure generated and then be capable of accommodating the resulting vacuum force generated when the product cools down. In this way, the panel can be inverted from the upwardly-inclined position as shown in FIG. 11*a* to the downwardly-inclined position as shown in FIG. 12*a*, except that the mechanical action is not provided. The force is instead provided by the internal pressure of the contents.

Referring again to FIGS. 12*a-d*, it can be seen that by the provision of the folding portion 20 in the bottom of the side wall 9 of the container 10, the majority of the side wall 9 can be absent any structural features so that the container 10 can essentially replicate a glass container, if so desired.

Although particular structures for the bottom portion of the side wall 9 are shown in the accompanying drawings it will be appreciated that alternative structures could be provided. For example, a plurality of folding portions could be incorporated about the base 2 in an alternative embodiment.

There may also be provided many different decoupling or hinge structures 13 without departing from the scope of the invention. With particular reference to FIGS. 6 and 7, it can be seen that the side of the decoupling structure 13 that is provided for the pressure panel 11 may be of an enlarged area to provide for increased longitudinal movement upwards into the container following inversion.

Figure 13A:
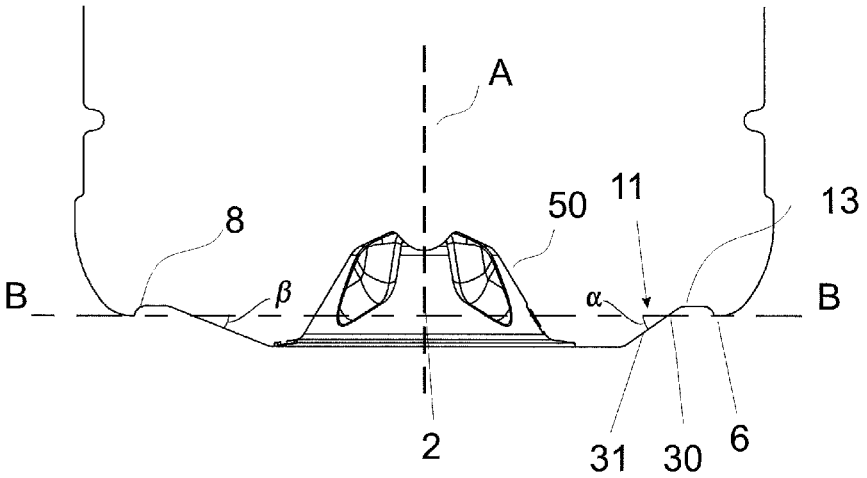
FIG. 13*a*: shows the base of an alternative embodiment of the invention before collapsing.
Figure 14:
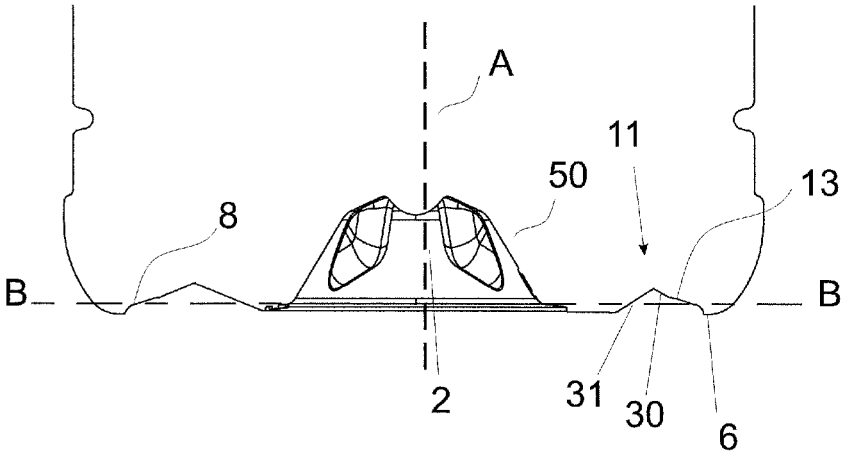
FIG. 14: shows the base of FIG. 13*a* during the initial stages of collapsing.
Figure 13B:
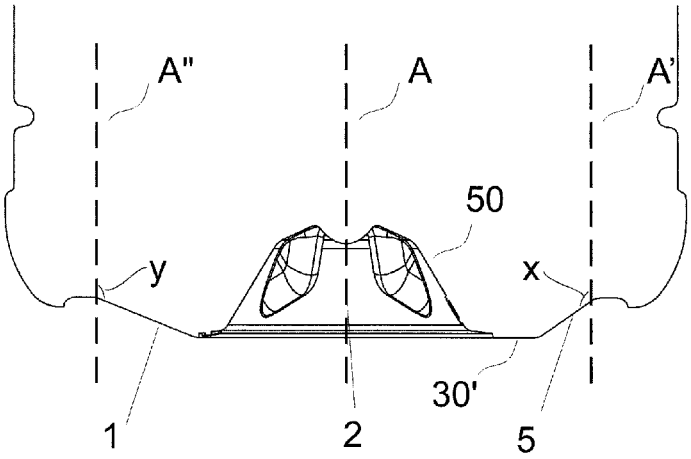
FIG. 13*b*: shows the FIG. 13*a* alternative embodiment and illustrating an alternative frame of reference for surface angles.
Figure 13C:
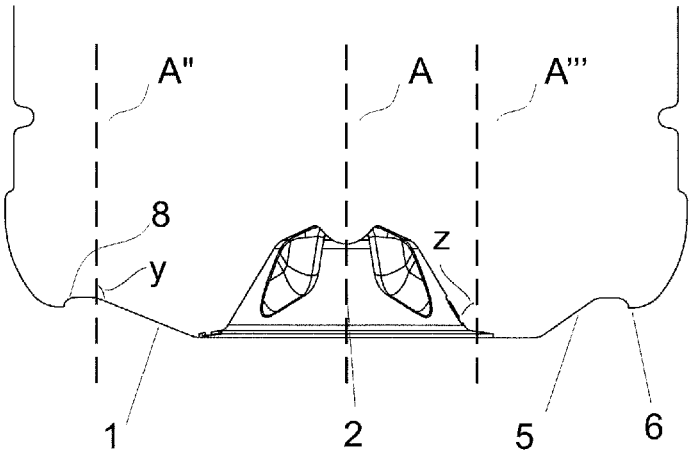
FIG. 13*c*: shows the Figure 13*b* alternative embodiment and illustrating an alternative frame of reference for surface angles.
Figure 15A:
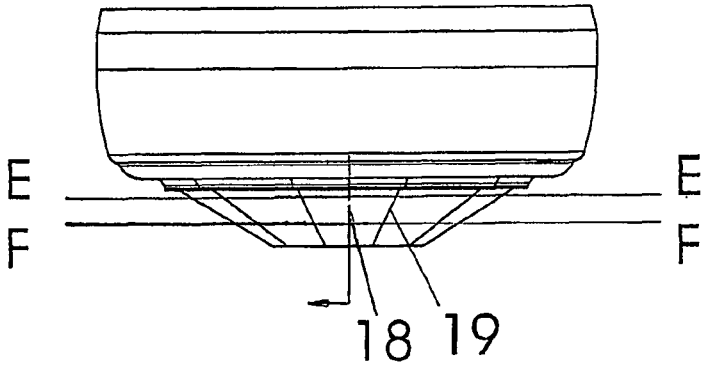
FIGS. 15*a-b*: show side and cross-sectional views of the container shown in FIG. 9 including outwardly projecting fluting.
Figure 15B:
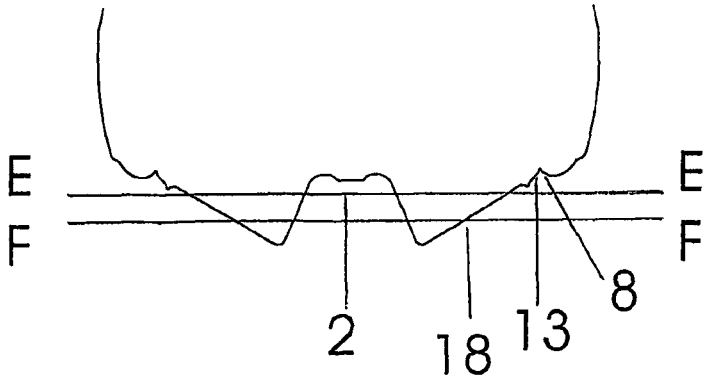
Figure 15C:
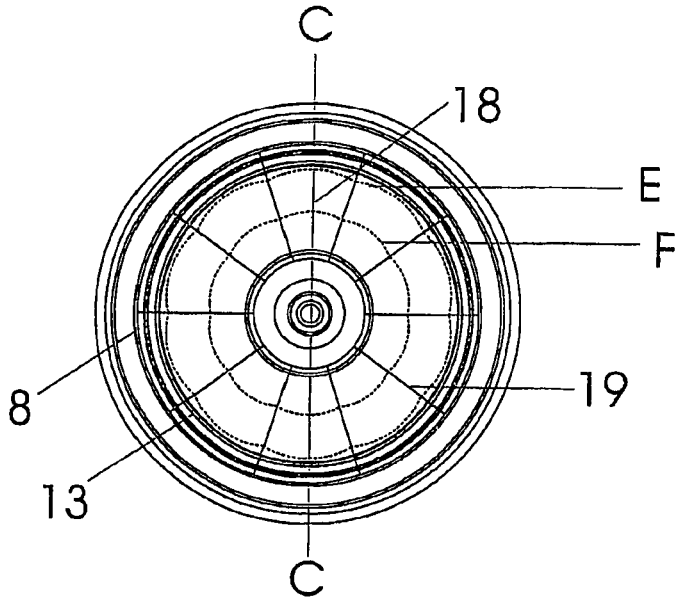
FIG. 15*c*: shows a bottom view of the base of the container of FIGS. 15*a* and 15*b* with dotted contour section lines through lines E-E and F-F.
Figure 15D:
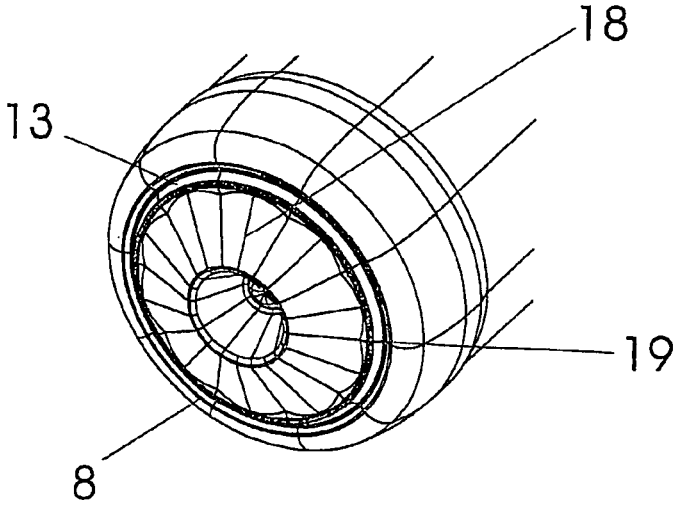
FIG. 15*d*: shows a perspective view of the base of the container of FIGS. 15*a-c;*

Referring to FIGS. 13*a* and 14, another exemplary embodiment of the present invention is shown. As shown in FIG. 13*a*, in this embodiment, the initiator portion 30 and the control portion 31 can define a substantially continuous curve (as viewed in the plane of the paper), without any sharp curves or severe angles. In addition, the initiator portion 30 can be located further from the longitudinal axis A than the control portion, that is, the initiator portion 30 can be located adjacent the wider regions of the pressure panel 11, and the control portion 31 can be located adjacent the narrower regions of the pressure panel. The initiator portion 30 can invert earlier than the control portion 31. The initiator portion 30 may be constructed with this in mind (e.g., by having thinner material, or a lesser angle of inclination, than the control portion 31) and so on, to provide for the panel 11 to begin inverting where it has the greater diameter, ahead of the narrower sections of the panel. In this case, the portion 30 of the panel, which is radially set more distant from the central axis of the container, inverts ahead of portion 31 to act as the initiator portion.

Alternatively, the initiator portion can be located closer to the longitudinal axis A than the control portion. For example, referring to FIGS. 13*b* and 13*c*, the portion of the panel labeled 30' can serve as the initiator portion (i.e., portion 30' can start inverting prior to control portion 5). For example, initiator portion 30' can be formed of a thinner material than control portion 5, or, as shown, can have a smaller angle of inclination with respect to the longitudinal axis A than the control portion 5. Additionally or alternatively, the centrally-located push-up 50 can serve as the initiator portion, provided it is formed resilient enough to initiate inversion of the pressure panel 11.

Where in the foregoing description, reference has been made to specific components or to integers of the invention having known equivalents then such equivalents are herein incorporated as if individually set forth. Although this invention has been described by way of example and with reference to possible embodiments thereof, it is to be understood that modifications or improvements may be made thereto without departing from the scope of the invention as defined in the appended claims.

What is claimed:

1. A plastic container having a longitudinal axis, and comprising: an upper portion including an opening into the container; a sidewall portion extending from the upper portion to a lower portion, the lower portion including a base; and a pressure panel located in the lower portion substantially transversely to the longitudinal axis, the pressure panel being movable substantially along the longitudinal axis between an initial position and an inverted position to compensate for a change of pressure induced within the container; wherein the pressure panel comprises a centrally located push-up portion adapted to move in response to a longitudinally directed force and cause the pressure panel to at least partially invert; wherein when in the initial position a control portion of the pressure panel defines an angle with respect to the longitudinal axis and the opening into the container that is greater than about 100 degrees; and wherein the push-up portion defines an angle of inclination with respect to the longitudinal axis and the opening into the container that is less than that of the control portion.

2. The container of claim 1, wherein the pressure panel is adapted to move from the initial position to the inverted position under an externally applied mechanical force.

3. The container of claim 1, wherein the pressure panel is adapted to move from the initial position to the inverted position in response to internal vacuum forces within the container.

4. The container of claim 1, wherein the pressure panel includes an invertible portion defining an angle of outward inclination with respect to a plane orthogonal to the longitudinal axis that is less than the control portion.

5. The container of claim 4, wherein the invertible portion is located closer to the longitudinal axis than is the control portion.

6. The container of claim 5, wherein the invertible portion and the control portion define a substantially continuous curve when viewed in a cross-sectional plane extending through the longitudinal axis.

7. The container of claim 1, wherein the pressure panel begins to invert first from the widest diameter, and further from the longitudinal axis.

8. The container of claim 7, wherein the pressure panel comprises more than one initiator portion.

9. The container of claim 8, wherein the pressure panel also comprises an invertible initiator portion located further from the longitudinal axis than the control portion.

10. The container of claim 8, wherein the pressure panel comprises an initiator portion located adjacent to the push-up portion and closer to the longitudinal axis than the control portion.

11. The container of claim 10, wherein the initiator portion defines an angle of inclination with respect to the longitudinal axis and the opening into the container that is less than the control portion.

12. The container of claim 1, wherein when in the initial position, at least a portion of the pressure panel defines an angle of inclination with respect to a plane orthogonal to the longitudinal axis that is greater than about 15 degrees.

13. The container of claim 1, further comprising a hinge structure connecting the pressure panel to the lower portion.

14. The container of claim 1, further comprising a standing surface and an instep or recess between the pressure panel and the standing surface.

15. A plastic container having a longitudinal axis, and comprising: an upper portion including an opening into the container; a sidewall portion extending from the upper portion to a lower portion, the lower portion including a base; defining a standing surface; a pressure panel located in the lower portion substantially transversely to the longitudinal axis, the pressure panel being movable substantially along the longitudinal axis between an initial position and an inverted position to compensate for a vacuum pressure induced within the container; wherein when in the initial position, at least a portion of the pressure panel defines an angle of inclination with respect to a plane orthogonal to the longitudinal axis that is greater than about 15 degrees downwardly inclined away from the upper portion; an instep or recess between the pressure panel and the standing surface; a hinge connecting the pressure panel to the instep; and a centrally located push-up portion wherein the portion defining an angle of inclination that is greater than about 15 degrees defines a control portion and the pressure panel moves from the initial position to the inverted position in response to internal vacuum forces developed within the container as a result of cooling of liquid contents within the container; and wherein the pressure panel comprises at least one initiator portion and a control portion, the initiator portion including the centrally located push-up portion and being adapted to move in response to the internal vacuum forces and cause the control portion to invert.

* * * * *